US006595619B2

(12) United States Patent
Barinaga et al.

(10) Patent No.: US 6,595,619 B2
(45) Date of Patent: Jul. 22, 2003

(54) PRINTING MECHANISM SERVICE STATION FOR A PRINTBAR ASSEMBLY

(75) Inventors: John A. Barinaga, Portland, OR (US); Daniel J. Fredrickson, Camas, WA (US); Geoff M. Wotton, Battle Ground, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 71 days.

(21) Appl. No.: 10/016,564

(22) Filed: Oct. 30, 2001

(65) Prior Publication Data

US 2003/0081053 A1 May 1, 2003

(51) Int. Cl.[7] ..... B41J 2/165; B41J 2/155
(52) U.S. Cl. ..... 347/32; 347/42
(58) Field of Search ..... 347/22, 29, 31, 347/33, 32, 42, 49

(56) References Cited

U.S. PATENT DOCUMENTS 5,943,071 A * 8/1999 Premnath ..... 347/33
6,139,129 A * 10/2000 Tabasso et al. ..... 347/33

* cited by examiner

*Primary Examiner*—Thinh Nguyen

(57) ABSTRACT

A print unit, such as an inkjet printing mechanism, includes a printbar assembly that has print modules with one or more printheads that collectively span a print region corresponding to a width of a print media and deposit an imaging medium, such as ink, onto the print media. Wiper assemblies move from a print position to a service position in the print region to service the one or more printheads of the print modules. A wiper assembly has one or more wipers that correspond to the one or more printheads, such that when the wiper assembly and the print module are positioned in the service position, the wipers clean the printheads. The wiper assembly also has one or more printhead caps that cover the one or more printheads on the print modules.

48 Claims, 9 Drawing Sheets

Wiper Assembly

Printbar Assembly

PRINTING MECHANISM SERVICE STATION FOR A PRINTBAR ASSEMBLY

TECHNICAL FIELD

This invention relates to printing mechanisms and, in particular, to page wide array printbars and wiper assemblies.

BACKGROUND

An inkjet printer includes a printing assembly having a printhead, or printheads, to deposit ink onto a print media, such as paper. A printhead has an orifice plate that is formed with nozzles through which ink drops are "fired", or otherwise ejected, onto the print media to form an image, such as text or a picture. The ink drops dry, or are heated to dry, on the print media shortly after deposition to form the printed image.

There are various types of inkjet printheads including, for example, thermal inkjet printheads and piezoelectric inkjet printheads. For a thermal inkjet printhead, ink droplets are ejected from individual nozzles by localized heating with a heating element located at individual nozzles. An electric current is applied to a heating element to heat it up which causes a small volume of ink to be rapidly heated and vaporized. Once vaporized, the ink is ejected through the nozzle. A driver circuit is coupled to individual heating elements to provide the energy pulses and thereby controllably deposit ink drops from associated individual nozzles. The drivers are responsive to character generators and other image forming circuitry to energize selected nozzles of a printhead for forming images on the print media.

During printing, ink tends to build up at the nozzle orifices of a printhead. This build-up of residual ink can be caused by ink droplets that are not completely ejected from a nozzle, excess ink at the orifice that is not fully vaporized, or ink spatterings that reflect from the print media when the ink is ejected. The small nozzle orifices of a printhead are also susceptible to clogging by quick drying ink, dust particles and paper fibers, and from solids within the ink. Partially or completely blocked nozzles can result in either missing or misdirected ink drops being deposited onto the print media, either of which impairs printing and degrades the print quality.

The printing assembly typically includes a service station having wipers to clean and preserve the functionality of the printheads. The service station includes a wiper, or wipers, for wiping a printhead to remove ink residue and other contaminants that have been deposited or collected on the printhead surface and over the nozzle openings in the printhead surface. A service station can also include a cap, or capping mechanism, which covers a printhead when the printer is not printing to prevent the ink in the nozzles from drying, and to prevent contaminants from collecting in and over the nozzles.

A conventional inkjet printer has a print unit that includes a reciprocating inkjet pen carriage system for travel back and forth across a print zone along an axis that spans a print media, or otherwise spans a printing width. A conventional print unit also includes a service station fixed within the inkjet printer away from the print zone. To service the printhead nozzles of the inkjet pen carriage system, the carriage system travels along the axis and away from the print zone, or outside of the print zone, to the service station.

With the advent of page wide array printbar assemblies having multiple printheads that span the width of a print media, or otherwise span a printing width, there is a need for improved printing mechanisms having printbar assemblies that are accessible to clean the multiple printheads, and service station assemblies that move wipers and printhead caps to the printheads, rather than the printheads being moved to the wipers at a service station.

SUMMARY

A print unit, such as an inkjet printing mechanism, includes a printbar assembly that has print modules with one or more printheads to deposit an imaging medium, such as ink, onto a print media. The one or more printheads of the print modules collectively span a width of a print media, or print region, when the printbar assembly is in a print position.

The print unit also includes a service station having a wiper assembly with one or more wipers that correspond to the one or more printheads on the printbar assembly, such that when a wiper assembly and a printbar assembly are positioned in proximity to service the printheads, the wipers clean the printheads of ink residue and contaminants.

The wiper assembly moves from a print position to a service position within the print region to service the one or more printheads on the printbar assembly. In addition to having one or more wipers, the wiper assembly has one or more printhead caps that cover the one or more printheads on the printbar assembly.

BRIEF DESCRIPTION OF THE DRAWINGS

The same numbers are used throughout the drawings to reference like features and components.

DETAILED DESCRIPTION

Introduction

The following describes systems and methods for a printing mechanism having printbar assemblies and service station configurations. A printbar assembly, also referred to as a page wide array printbar, has printheads that overlap for continuous printing across the width of a print media, and is capable of printing more pages at a faster rate than conventional scanning, or reciprocating, type pen carriage systems that travel back and forth across a print zone to print. A service station has wiper assemblies to clean printheads on printbar assemblies that span a print region. The wiper assemblies are positioned within the print region, or otherwise move into the print region, to service the printheads. Locating the wiper assemblies within the print region provides a fast response to clean the printheads on the printbar assembly because of the close proximity to the printheads. The printbar assemblies and service station configurations described herein can be implemented in many different printing devices, to include inkjet printing devices.

Exemplary Printer Architecture

Figure 1:
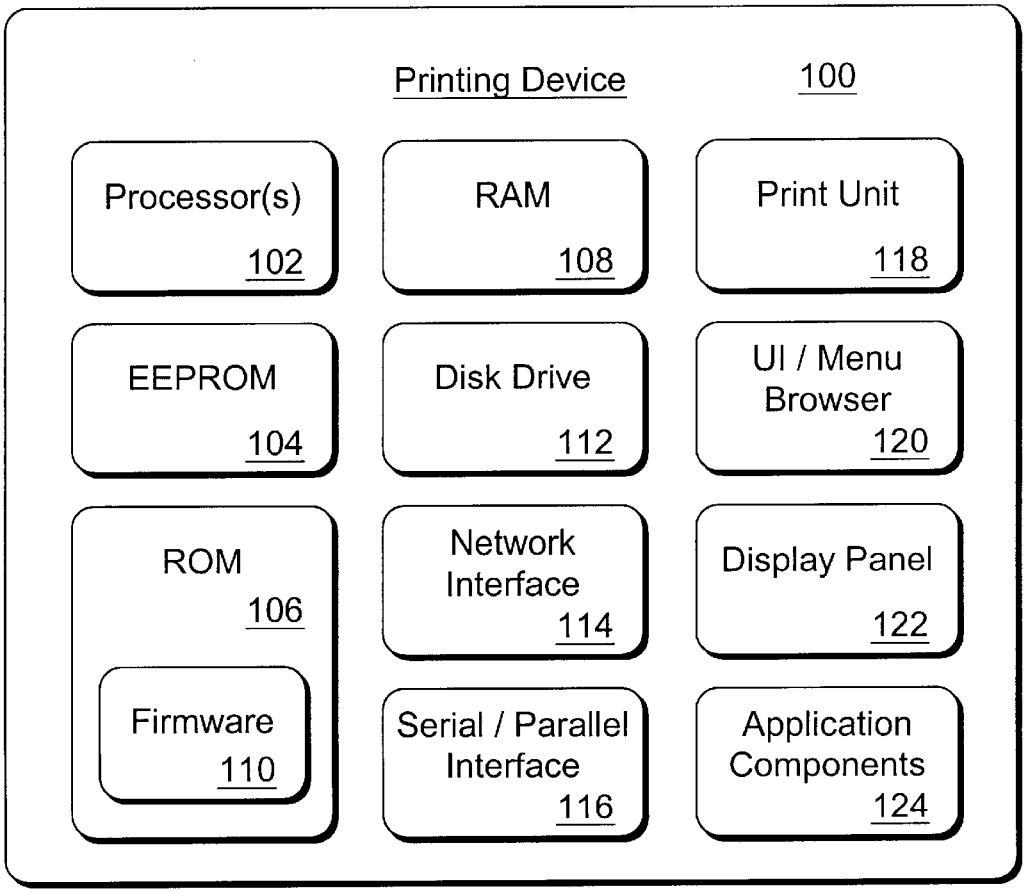
FIG. 1 is block diagram that illustrates various components of an exemplary printing device.

FIG. 1 illustrates various components of an exemplary printing device 100 that can be utilized to implement the inventive techniques described herein. Printer 100 includes one or more processors 102, an electrically erasable programmable read-only memory (EEPROM) 104, ROM 106 (non-erasable), and a random access memory (RAM) 108. Although printer 100 is illustrated having an EEPROM 104 and ROM 106, a particular printer may only include one of the memory components. Additionally, although not shown, a system bus typically connects the various components within the printing device 100.

The printer 100 also has a firmware component 110 that is implemented as a permanent memory module stored on ROM 106. The firmware 110 is programmed and tested like software, and is distributed with the printer 100. The firmware 110 can be implemented to coordinate operations of the hardware within printer 100 and contains programming constructs used to perform such operations.

Processor(s) 102 process various instructions to control the operation of the printer 100 and to communicate with other electronic and computing devices. The memory components, EEPROM 104, ROM 106, and RAM 108, store various information and/or data such as configuration information, fonts, templates, data being printed, and menu structure information. Although not shown, a particular printer can also include a flash memory device in place of or in addition to EEPROM 104 and ROM 106.

Printer 100 also includes a disk drive 112, a network interface 114, and a serial/parallel interface 116. Disk drive 112 provides additional storage for data being printed or other information maintained by the printer 100. Although printer 100 is illustrated having both RAM 108 and a disk drive 112, a particular printer may include either RAM 108 or disk drive 112, depending on the storage needs of the printer. For example, an inexpensive printer may include a small amount of RAM 108 and no disk drive 112, thereby reducing the manufacturing cost of the printer.

Network interface 114 provides a connection between printer 100 and a data communication network. The network interface 114 allows devices coupled to a common data communication network to send print jobs, menu data, and other information to printer 100 via the network. Similarly, serial/parallel interface 116 provides a data communication path directly between printer 100 and another electronic or computing device. Although printer 100 is illustrated having a network interface 114 and serial/parallel interface 116, a particular printer may only include one interface component.

Printer 100 also includes a print unit 118 that includes mechanisms arranged to selectively apply an imaging medium such as liquid ink, toner, and the like to a print media in accordance with print data corresponding to a print job. Print media can include any form of media used for printing such as paper, plastic, fabric, Mylar, transparencies, and the like, and different sizes and types such as 8½×11, A4, roll feed media, etc. For example, print unit 118 can include an inkjet printing mechanism that selectively causes ink to be applied to a print media in a controlled fashion. The ink on the print media can then be more permanently fixed to the print media, for example, by selectively applying conductive or radiant thermal energy to the ink. Those skilled in the art will recognize that there are many different types of print units available, and that for the purposes of the present invention, print unit 118 can include any of these different types.

Printer 100 also includes a user interface and menu browser 120, and a display panel 122. The user interface and menu browser 120 allows a user of the printer 100 to navigate the printer's menu structure. User interface 120 can be indicators or a series of buttons, switches, or other selectable controls that are manipulated by a user of the printer. Display panel 122 is a graphical display that provides information regarding the status of the printer 100 and the current options available to a user through the menu structure.

Printer 100 can, and typically does include application components 124 that provide a runtime environment in which software applications or applets can run or execute. Those skilled in the art will recognize that there are many different types of runtime environments available. A runtime environment facilitates the extensibility of printer 100 by allowing various interfaces to be defined that, in turn, allow the application components 124 to interact with the printer.

General reference is made herein to one or more printing devices, such as printing device 100. As used herein, "printing device" means any electronic device having data communications, data storage capabilities, and/or functions to render printed characters and images on a print media. A printing device may be a printer, fax machine, copier, plotter, and the like. The term "printer" includes any type of printing device using a transferred imaging medium, such as ejected ink, to create an image on a print media, and using a wiper assembly to clean imaging medium residue from an imaging medium applicator.

Examples of such a printer can include, but are not limited to, inkjet printers, dry medium printers, copiers, facsimile machines, plotters, portable printing devices, cameras, and video printers, as well as multi-function devices such as a combination facsimile/printer or facsimile/scanner. Although specific examples may refer to one or more of these printers, such examples are not meant to limit the scope of the claims or the description, but are meant to provide a specific understanding of the described implementations.

Exemplary Printing Device

Figure 2:
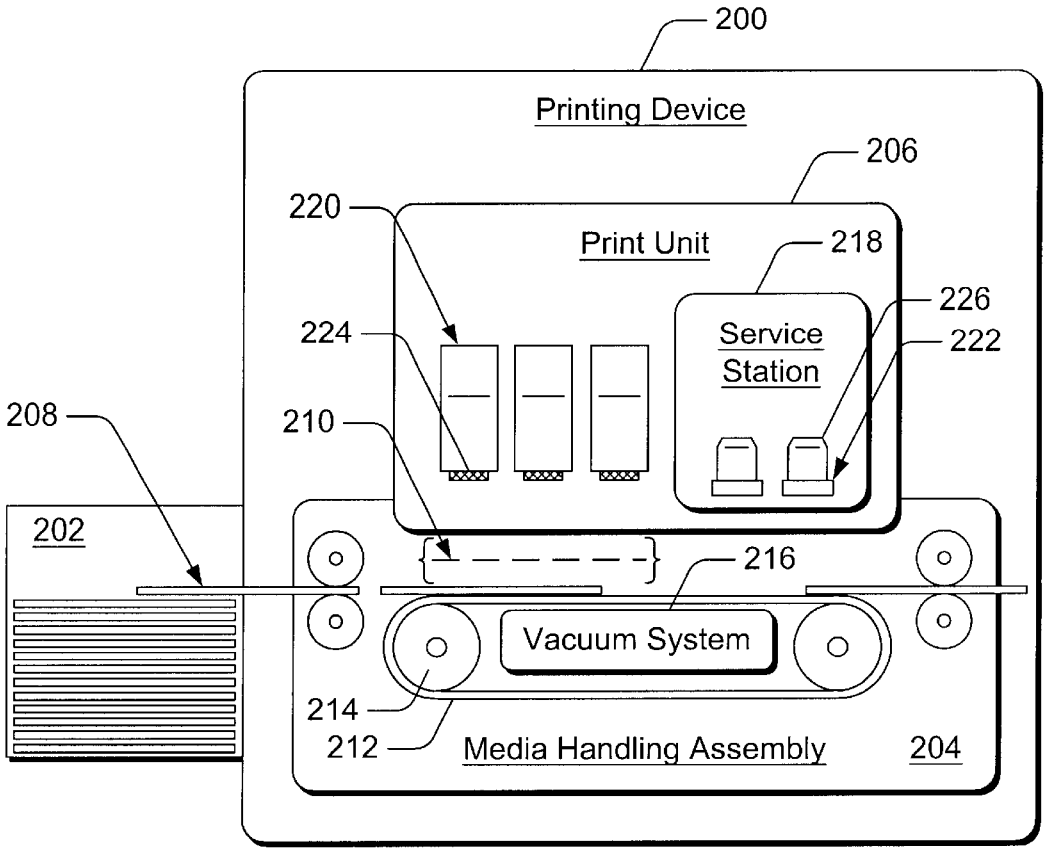
FIG. 2 is an illustration of various components of an exemplary printing device.

FIG. 2 illustrates a printing device 200 that can include one or more of the components of the exemplary printing device 100 (FIG. 1). The various exemplary printing device configurations are described in the environment and context of an inkjet printing device. While it is apparent that printing device components vary from one device to the next, those skilled in the art will recognize the applicability of the present invention to printing devices in general.

Printing device 200 includes a print media container 202, a media handling assembly 204, and a print unit 206. The print media container 202 holds print media 208 until the media handling assembly 204 takes up a print media and routes it through the printing device 200 for printing. The physical path of the print media through a printer is typically referred to as the "print path" or "print media path". When the print media 208 is routed within printing device 200 by the media handling assembly 204, the print media passes through a print region 210 in the printing device. Within print region 210, an imaging medium, such as ink, is transferred from the print unit 206 to print media 208 in response to the printing device 200 receiving print data corresponding to a print job.

The media handling assembly 204 includes components to route print media 208 through the printing device 200. The media handling assembly components include a media routing belt 212 that is positioned to route the print media 208 through the print region 210. The media routing belt 212 can be formed of a metal material, or other material that withstands the structural demands imposed by the printing process, to include localized heat that is generated to permanently fix an imaging medium, such as ink, to a print media.

The media routing belt 212 is driven by a belt drive and/or pulley and roller system 214 which is coupled to a motor drive unit (not shown). Those skilled in the art will recognize that there are any number of media handling assembly configurations that can be implemented in any number of printing devices to route print media through a printing device.

The media handling assembly also includes a vacuum system 216 to hold a print media 208 on the media routing belt 212 while the print media 208 is routed through the printing device 200. The media routing belt 212 can be perforated, or otherwise facilitate air flow through it, such that the vacuum system 216 located underneath the belt can hold the print media 208 on top of the belt while the print media is routed through the print region 210.

Figure 3:
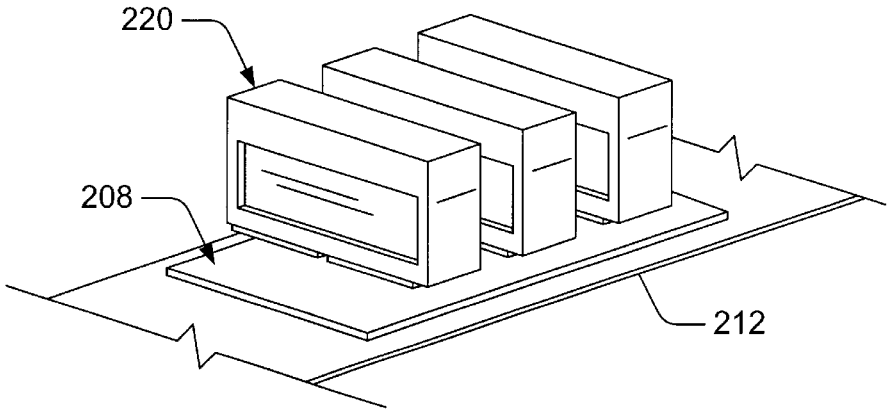
FIG. 3 is an illustration of printbar assemblies positioned for printing a print media.

Print unit 206 includes a service station 218 and a printbar assembly 220. The print unit 206 can have one or more printbar assemblies to deposit an imaging medium onto a print media 208 within the print region 210. Printbar assembly 220 is illustrated from an end-view, and spans the width of a print media 208 as the print media is routed in printing device 200. FIG. 3 illustrates a configuration of more than one printbar assembly 220 positioned for printing over a print media 208 that is routed in printing device 200 via the media routing belt 212.

Service station 218 includes a wiper assembly 222 that is mounted on, coupled to, and/or integrated with service station 218 to clean nozzle sections of printheads 224 on the printbar assembly 220. A wiper assembly 222 has wipers 226 to clean the printheads 224 and remove ink residue and contaminants to maintain a desired printing quality.

The printheads 224 are cleaned periodically during operation of printing device 200. A processor, or processors, in printing device 200 schedules routine servicing of the printheads based upon the printing time, the number of ink drops being ejected, and/or other printing related factors. For example, the printheads can be cleaned after an approximate time duration, such as after every ten minutes of printing time, or the printheads can be cleaned after a number of print media pages are printed, such as after every one-hundred pages. The service station 218 can have multiple wiper assemblies corresponding to multiple printbar assemblies in print unit 206.

Exemplary Printbar Assembly

Figure 4:
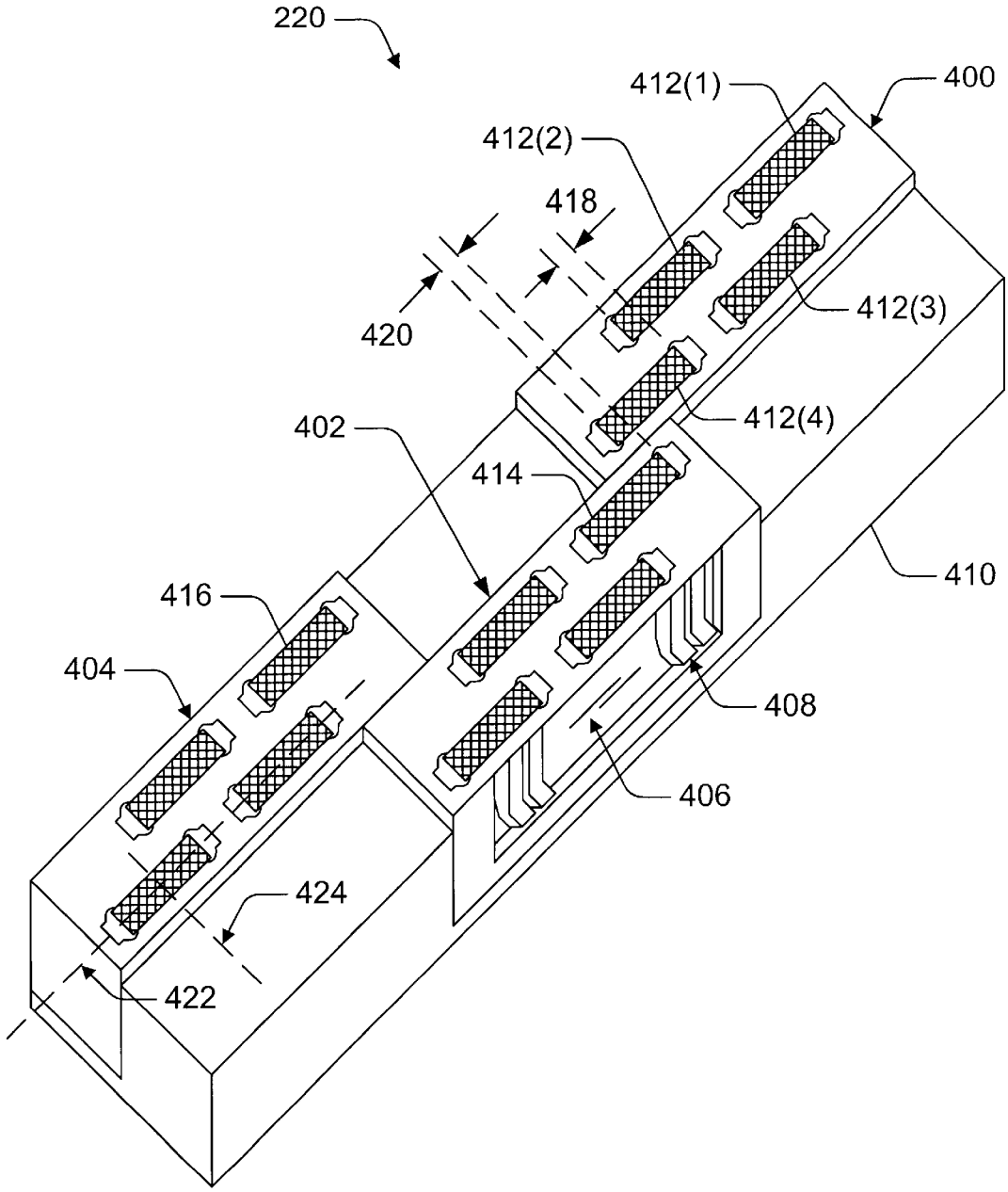
FIG. 4 is an illustration of an exemplary printbar assembly having print modules and multiple printheads.

FIG. 4 illustrates components of an exemplary printbar assembly 220. The printbar assembly 220 is shown having three print modules 400, 402, and 404, although any number of print modules can be combined in a printbar assembly to span the width of a print media, a print region, or span a printing width. A print module is also commonly referred to as a "cartridge", or a "pen". Conventionally, a print module includes an ink reservoir 406 to store a supply of ink and electrical connectors 408 to receive printing control signals from one or more printing device processors.

The printbar assembly 220 has a framework 410 to support and align the print modules, and to install the printbar assembly in a printing device. Those skilled in the art will recognize that any number of varying framework configurations can be implemented to support the print modules, and the printbar assembly in a printing device.

A print module, such as print module 400, has any number of printheads 412, each having multiple nozzles that eject ink onto a print media to form an image. A printhead is also commonly referred to as a "die". Print module 402 has multiple printheads such as printhead 414, and print module 404 has multiple printheads such as printhead 416. Each printhead has a longitudinal axis 422 and a transverse axis 424.

Collectively, the printheads on print bar assembly 220 span a printing width, a print region, or a print media width, and overlap to effectively deposit or transfer an imaging medium across the printing width without gaps in the imaging medium. The printheads on an individual print module overlap, and the printheads on adjacent print modules overlap. For example printheads 412(2) and 412(4) on print module 400 have an overlap 418, and printhead 412(4) on print module 400 has an overlap 420 with printhead 414 on print module 402.

Exemplary Print Unit Configurations

Figure 5:
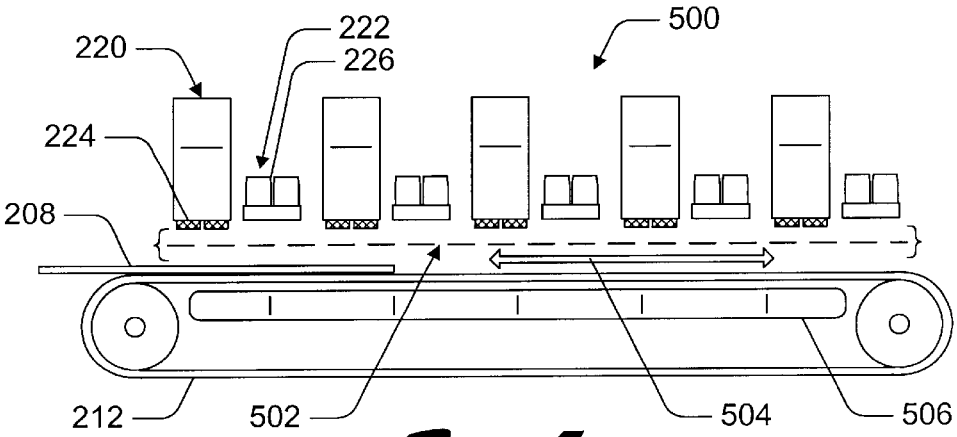
FIG. 5 is an illustration of an exemplary print unit configuration having multiple printbar assemblies and corresponding wiper assemblies in a print position.

FIG. 5 illustrates an exemplary print unit configuration 500 having multiple printbar assemblies and corresponding wiper assemblies. Printbar assembly 220 and wiper assembly 222 are shown in a print position within, or over, a print region 502 such that the wiper assembly does not interfere with the printbar assembly when an imaging medium is transferred onto the print media 208.

The printbar assemblies, such as printbar assembly 220, each have multiple printheads 224 that collectively span a width of a print media 208. Print media 208 is routed in a printing device via the media routing belt 212 (FIG. 2). An arrow 504 identifies a horizontal plane of the print media 208. Wiper assembly 222 includes wipers 226 to clean printheads 224 and remove ink residue and contaminants. Print unit configuration 500 also includes a heater 506, or heaters, below the media routing belt 212 to provide conductive heat that dries the imaging medium after it is transferred onto the print media 208.

Figure 6:
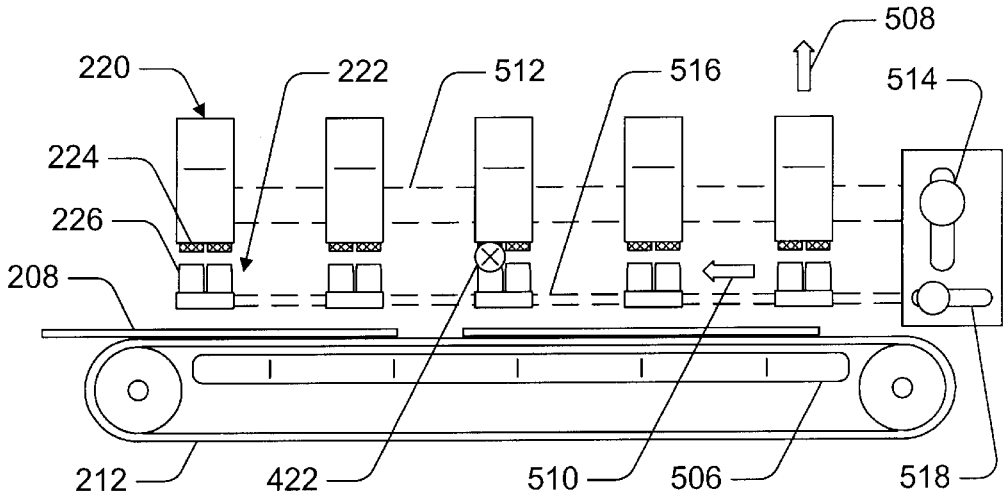
FIG. 6 is an illustration of the exemplary print unit configuration shown in FIG. 5 having multiple printbar assemblies and corresponding wiper assemblies in a service position.

FIG. 6 illustrates the printbar assemblies and wiper assemblies shown in FIG. 5 in a service position. Printbar assembly 220 moves in a direction indicated by arrow 508 to a printbar assembly service position to allow access to clean printheads 224 in a space between printheads 224 and print media 208. The direction indicated by arrow 508 is perpendicular to the horizontal plane 504 (FIG. 5) of the print media 208.

The wiper assemblies, such as wiper assembly 222, is shown in a wiper assembly service position. The wiper assembly 222 moves in a direction indicated by arrow 510 from the print position, as shown in FIG. 5, to the service position shown in FIG. 6. From the service position, the wiper assembly wipers 226 clean printheads 224 when the wiper assembly 222 is moved in a direction that is parallel to a longitudinal axis 422 (FIG. 4) of the printheads.

The printbar assemblies, such as printbar assembly 220, has a support structure 512 that couples the printbar assemblies to a printbar assembly positioning mechanism 514. The printbar assembly positioning mechanism 514 can be coupled to a motor drive unit (not shown) to move the printbar assemblies from the print position to the service position in the direction indicated by arrow 508. Those skilled in the art will recognize that there are any number of positioning mechanism configurations that can be implemented in any number of printing devices to position the printbar assemblies. Furthermore, the individual printbar assemblies can be moved independently to facilitate servicing a first printbar assembly with a corresponding wiper assembly while a second printbar assembly continues to transfer the imaging medium onto the print media 208.

The wiper assemblies, such as wiper assembly 222, has a support structure 516 that couples the wiper assemblies to a wiper assembly positioning mechanism 518. The wiper assembly positioning mechanism 518 can be coupled to a motor drive unit (not shown) to move the wiper assemblies from the print position to the service position in the direction indicated by arrow 510. Those skilled in the art will recognize that there are any number of positioning mechanism configurations that can be implemented in any number of printing devices to position the wiper assemblies. Furthermore, the individual wiper assemblies can be moved independently to facilitate servicing a first printbar assembly with a corresponding wiper assembly while a second printbar assembly continues to transfer the imaging medium onto the print media 208. The support structure 516 and the wiper assembly positioning mechanism 518 interact to maintain contact between wipers 226 and printheads 224 when wiper assembly 222 moves in a direction that is parallel to a longitudinal axis 422 (FIG. 4) of the printheads.

Figure 7:
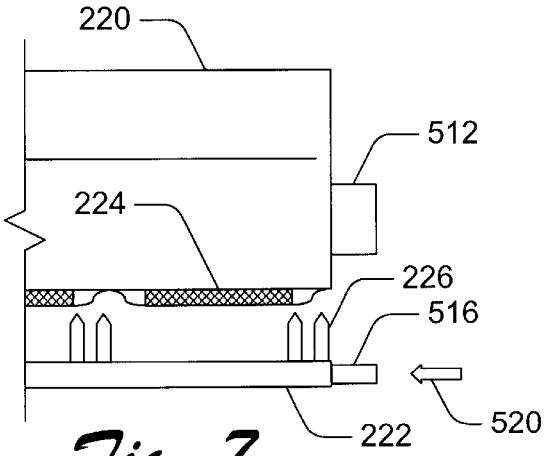
FIG. 7 is an illustration of a side view of a printbar assembly and wiper assembly.

FIG. 7 illustrates a side view of a printbar assembly 220 and a corresponding wiper assembly 222 in a service position as shown in FIG. 6. In the service position, wiper assembly 222 is moved in a direction indicated by arrow 520 such that wipers 226 clean printheads 224. The direction indicated by arrow 520 corresponds to moving in a direction that is parallel to a longitudinal axis 422 (FIG. 4) of the printheads. It should be recognized that the movement between the wipers and the printheads is relative, and that the printheads can be moved across the wipers in a direction opposite to that indicated by arrow 520 to clean the printheads with the wipers. Furthermore, for bidirectional wiping, the wiper assembly 222 can be moved in a first direction indicated by arrow 520, and in a second direction opposite to that indicated by arrow 520, to clean printheads 224 with wipers 226.

Figure 8:
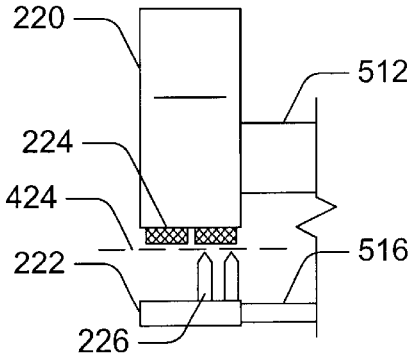
FIG. 8 is an illustration of an end view of a printbar assembly and a wiper assembly.

FIG. 8 illustrates an end view of a printbar assembly 220 and a corresponding wiper assembly 222 in a service position. The wipers 226 on the wiper assembly are rotated from the wipers' position shown in FIG. 6. In this position, the wipers contact and clean across the printheads 224 when the wiper assembly 222 moves in the direction indicated by arrow 510 (FIG. 6). When the wipers 226 are in the rotated position shown in FIG. 8, the direction of the wipers as indicated by arrow 510 corresponds to moving in a direction that is parallel to a transverse axis 424 (FIG. 4) of the printheads. Furthermore, for bi-directional wiping, the wiper assembly 222 can be moved in a first direction indicated by arrow 510, and in a second direction opposite to that indicated by arrow 510, to clean printheads 224 with wipers 226.

Figure 9:
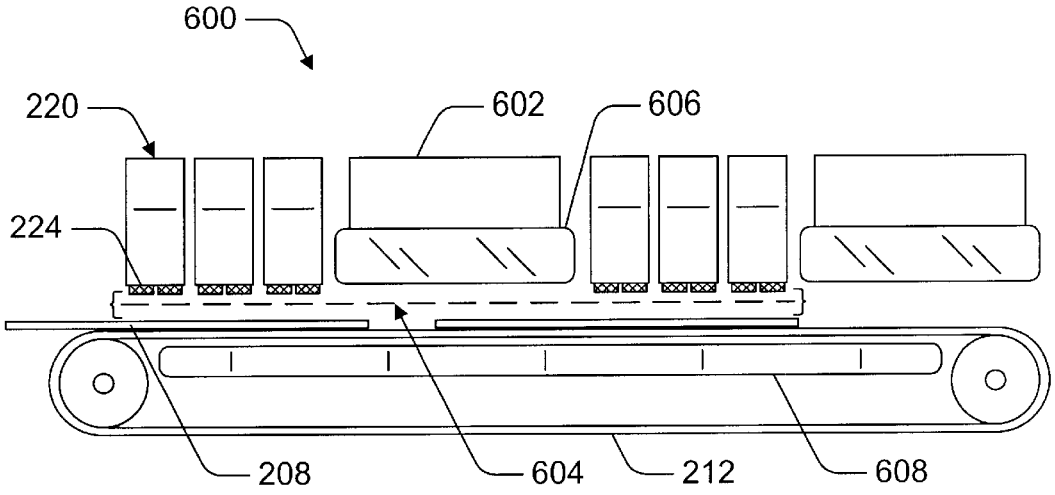
FIG. 9 is an illustration of an exemplary print unit configuration having multiple printbar assemblies and a service station in a print position.

FIG. 9 illustrates an exemplary print unit configuration 600 having multiple printbar assemblies and corresponding service stations. The printbar assemblies, such as printbar assembly 220, are shown in an array group of three printbars in a print position adjacent a service station 602, although any number of printbar assemblies can be positioned together. The printbar assemblies and the service station are positioned within, or over, a print region 604 such that the service station 602 does not interfere with the printbar assembly 220 when an imaging medium is transferred onto the print media 208.

The service station is positioned over a heater 606 that provides radiant and/or convective heat to dry the imaging medium after it is transferred onto the print media 208. Print unit configuration 600 also includes a heater 608, or heaters, below the media routing belt 212 to provide conductive heat that dries the imaging medium after it is transferred onto the print media 208. Print unit configuration 600 can include either heater 606, or heater 608, or both.

Figure 10:
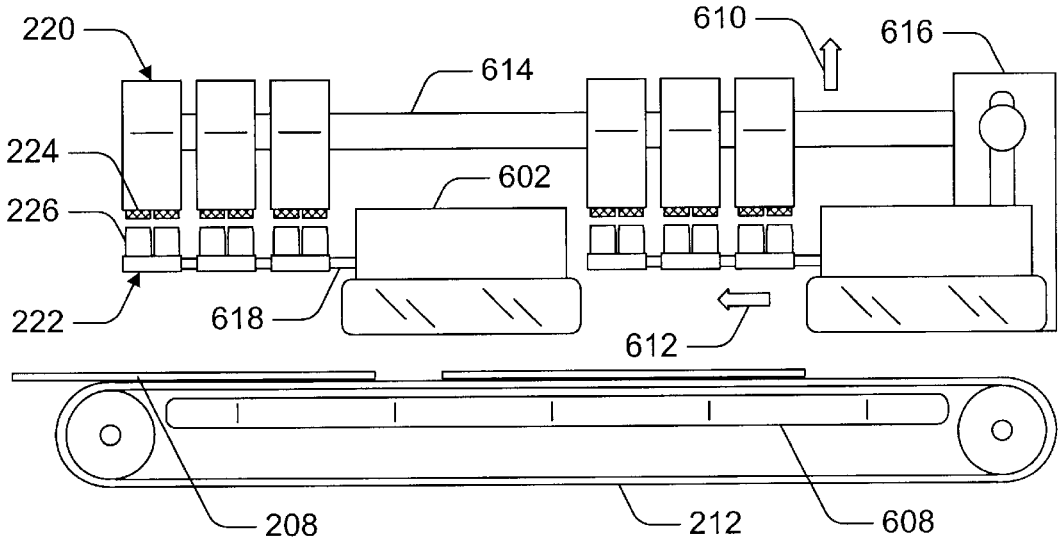
FIG. 10 is an illustration of the exemplary print unit configuration shown in FIG. 9 having multiple printbar assemblies and corresponding wiper assemblies in a service position.

FIG. 10 illustrates the printbar assemblies shown in FIG. 9 and wiper assemblies in a service position. Printbar assembly 220 moves in a direction indicated by arrow 610 to a printbar assembly service position to allow access to clean printheads 224 in a space between printheads 224 and print media 208. The direction indicated by arrow 610 is perpendicular to the horizontal plane 504 (FIG. 5) of the print media 208.

The wiper assemblies, such as wiper assembly 222, is shown in a wiper assembly service position. The wiper assembly 222 moves in a direction indicated by arrow 612 from the print position inside service station 602, as shown in FIG. 9, to the service position shown in FIG. 10. From the service position, the wiper assembly wipers 226 clean printheads 224 when the wiper assembly 222 is moved in a direction that is parallel to a longitudinal axis 422 (FIG. 4) of the printheads.

Alternatively, the wipers 226 on the wiper assembly can be positioned as shown in FIG. 8. In this position, the wipers contact and clean across the printheads 224 when the wiper assembly 222 moves in the direction indicated by arrow 612. When the wipers 226 are positioned on the wiper assembly 222 as shown in FIG. 8, the direction of the wipers as indicated by arrow 612 corresponds to moving in a direction that is parallel to a transverse axis 424 (FIG. 4) of the printheads. Furthermore, for bi-directional wiping, the wiper assembly 222 can be moved in a first direction indicated by arrow 612, and in a second direction opposite to that indicated by arrow 612, to clean printheads 224 with wipers 226.

The printbar assemblies, such as printbar assembly 220, has a support structure 614 that couples the printbar assemblies to a printbar assembly positioning mechanism 616. The printbar assembly positioning mechanism 616 can be coupled to a motor drive unit (not shown) to move the printbar assemblies from the print position to the service position in the direction indicated by arrow 610. Those skilled in the art will recognize that there are any number of positioning mechanism configurations that can be implemented in any number of printing devices to position the printbar assemblies. Furthermore, the individual printbar assemblies can be moved independently to facilitate servicing a first printbar assembly with a corresponding wiper assembly while a second printbar assembly continues to transfer the imaging medium onto the print media 208. For independent printbar assembly movement, more than one printbar assembly positioning mechanism can be implemented.

The wiper assemblies, such as wiper assembly 222, has a support structure 618 that couples the wiper assemblies to a wiper assembly positioning mechanism (not shown) located in service station 602. The wiper assembly positioning mechanism can be coupled to a motor drive unit (not shown) to move the wiper assemblies from the print position inside service station 602 to the service position in the direction indicated by arrow 612. Those skilled in the art will recognize that there are any number of positioning mechanism configurations that can be implemented in any number of printing devices to position the wiper assemblies. Furthermore, the individual wiper assemblies can be moved independently to facilitate servicing a first printbar assembly with a corresponding wiper assembly while a second printbar assembly continues to transfer the imaging medium onto the print media 208. The support structure 618 and the wiper assembly positioning mechanism interact to maintain contact between wipers 226 and printheads 224 when wiper assembly 222 moves in a direction that is parallel to a longitudinal axis 422 (FIG. 4) of the printheads.

Exemplary Wiper Assemblies

Figure 11:
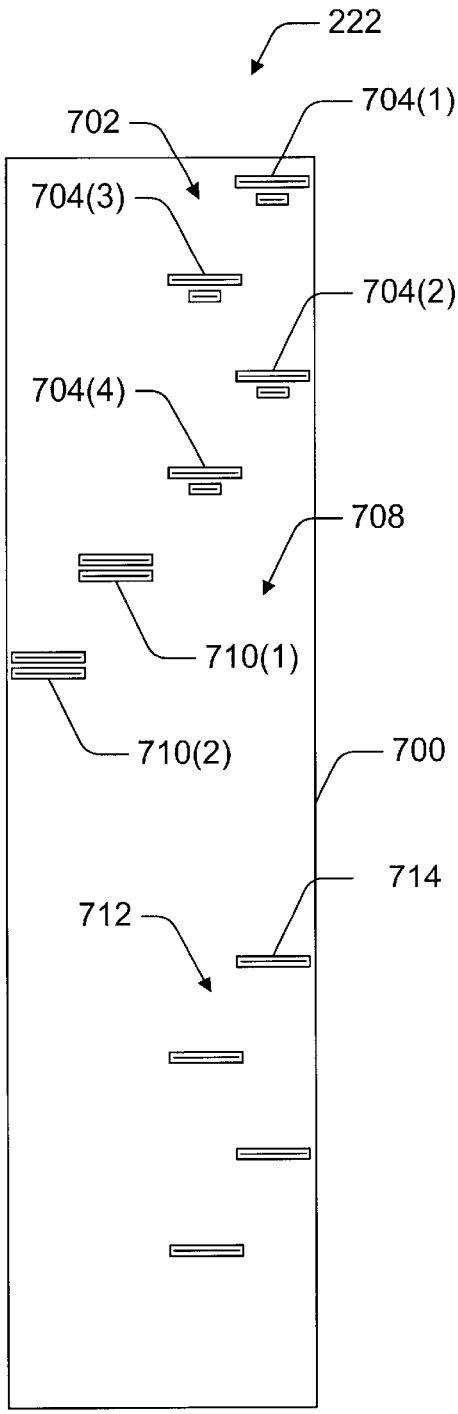
FIG. 11 is an illustration of a wiper assembly having various wiper configurations that correspond to printheads on a printbar assembly.
Figure 11:
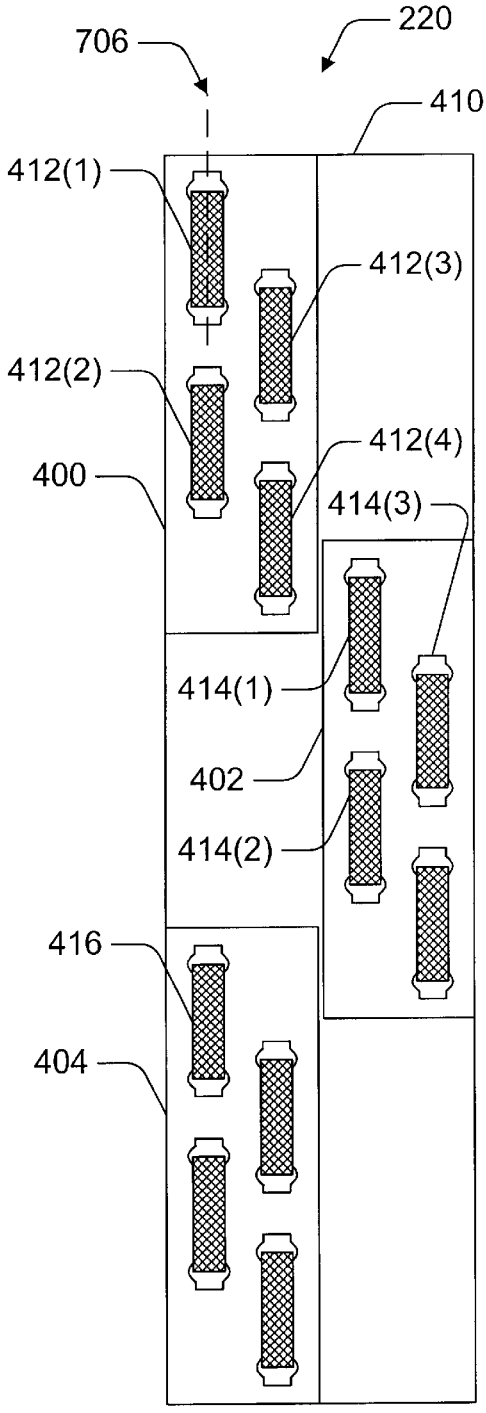

FIG. 11 illustrates components of an exemplary wiper assembly 222. The wiper assembly is shown adjacent printbar assembly 220 that is also illustrated in FIG. 4. FIG. 11 illustrates an exemplary alignment and configuration of wiper components on the wiper assembly 222 with corresponding printheads on the printbar assembly 220.

Wiper assembly 222 has a framework 700 to support the wiper components, and to install the wiper assembly in a printing device. Those skilled in the art will recognize that any number of varying framework configurations can be implemented to support the wiper components, and the wiper assembly in a printing device. Wiper assembly 222 can also include a drive mechanism (not shown) that facilitates the wiper assembly being positioned in proximity to a print bar assembly 220 such that wiper components on the wiper assembly 222 can contact and clean corresponding printheads on the printbar assembly 220. The drive mechanism can comprise any conventional drive coupling device that is mechanically coupled to and powered by a separate power source, such as a motor.

Wiper assembly 222 is shown having varying wiper component configurations in different regions of the wiper assembly, although it should be recognized that in practice, the wiper components would be standardized on the wiper assembly. In a first region 702 of wiper assembly 222, wipers 704 are illustrated in a configuration having two wipers, one having a width corresponding to one-half the width of a print module 400, and the other wiper having a width corresponding to the width of a printhead 412.

The wipers in region 702 correspond to the printheads 412 on print module 400. For example, wipers 704(1) correspond to printhead 412(1) (when the printbar assembly is "flipped over" and positioned above the wiper assembly, or vice-versa). When wipers 704(1) are positioned to contact printhead 412(1), the wipers are moved across the printhead in a direction that is parallel to a longitudinal axis 706 of printhead 412(1) to remove any ink residue and other contaminants from the printhead. It should be recognized that the movement between the wipers and the printhead is relative, and that the printhead can be moved across the wipers in a parallel direction relative to the wipers to clean the printhead. Furthermore, for bi-directional wiping, the wipers 704(1) can be moved in a first direction that is parallel to a longitudinal axis 706 of printhead 412(1), and in a second direction that is opposite to the first direction, to clean printhead 412(1).

In region 702 of wiper assembly 222, individual wipers 704 correspond to each of the printheads 412 on print module 400. That is, wipers 704(1) clean printhead 412(1), wipers 704(2) clean printhead 412(2), wipers 704(3) clean printhead 412(3), and wipers 704(4) clean printhead 412(4) when the wipers contact the printheads and move in a direction that is parallel to a longitudinal axis of the printheads.

In a region 708 of wiper assembly 222, wipers are illustrated in a configuration having two wipers that both correspond to one-half the width of a print module, such that the printheads and the entire width of the print module is cleaned when wiped with the wipers. The wipers 710 in region 708 correspond to printheads 414 on print module 402, and each set of wipers 710 correspond to two of the printheads 414 that are aligned on print module 402. For example, wipers 710(1) clean printhead 414(1) and printhead 414(2) when the wipers contact the printheads and move in a direction that is parallel to a longitudinal axis of the printheads.

In a region 712 of wiper assembly 222, wipers are illustrated in a configuration having only one wiper that corresponds to one-half the width of a print module, such that the printheads and the entire width of the print module is cleaned when wiped with the wipers. The wipers in region 712 correspond to printheads 416 on print module 404, and an individual wiper 714 corresponds to one printhead 416 on print module 404.

Figure 12:
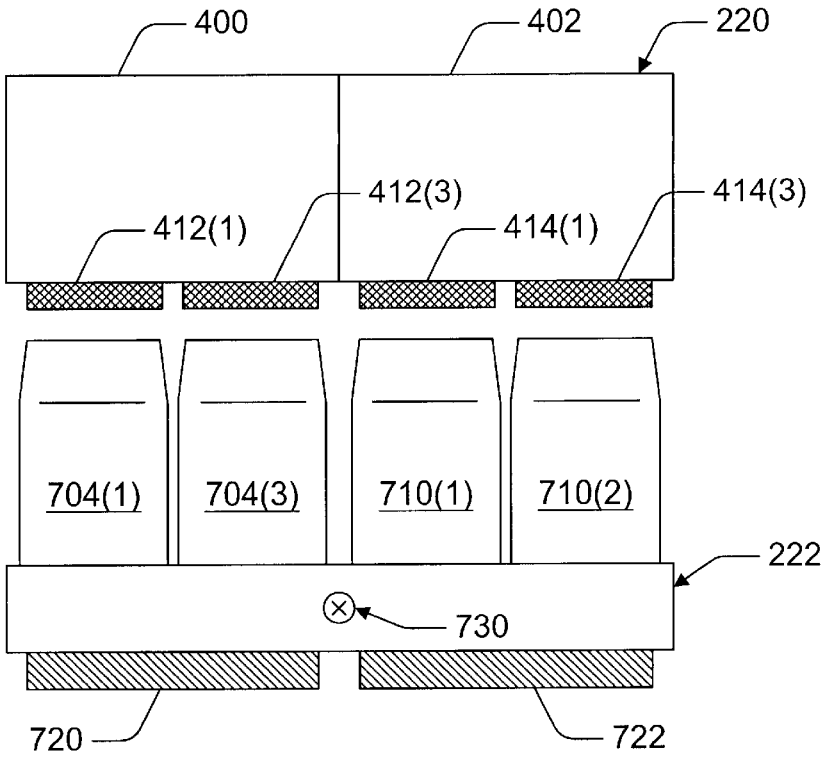
FIG. 12 is an illustration of a wiper assembly and wipers that correspond to printheads on a printbar assembly.

FIG. 12 illustrates an end-view of printbar assembly 220 and wiper assembly 222, such as shown in FIG. 11, positioned one over the other in proximity such that the wipers on wiper assembly 222 contact corresponding printheads on printbar assembly 220. For example, wipers 704(1) and 704(3) are positioned to contact and clean printheads 412(1) and 412(3) on print module 400, respectively. Additionally, wipers 710(1) and 710(2) are positioned and aligned to contact and clean printheads 414(1) and 414(3) on print module 402, respectively.

FIG. 12 also illustrates wiper assembly 222 having printhead caps 720 and 722 to cover printheads 414 on print module 402 and printheads 412 on print module 400, respectively. The printhead caps 720 and 722 prevent ink in the nozzles of the printheads from drying when the printer is sitting idle, and prevent contaminants from collecting in the nozzles and on the printheads.

To position the caps 720 and 722 in proximity to the printheads for the purpose of engaging the printheads and the printhead caps, the wiper assembly 222 is designed to rotate about a central longitudinal axis 730. When wiper assembly 222 is rotated about axis 730, and the printhead caps are positioned to engage the printheads, either the wiper assembly 222 and/or the printbar assembly 220 can be move d in relation to the other to engage and cover the printheads with the printhead caps.

Figure 13:
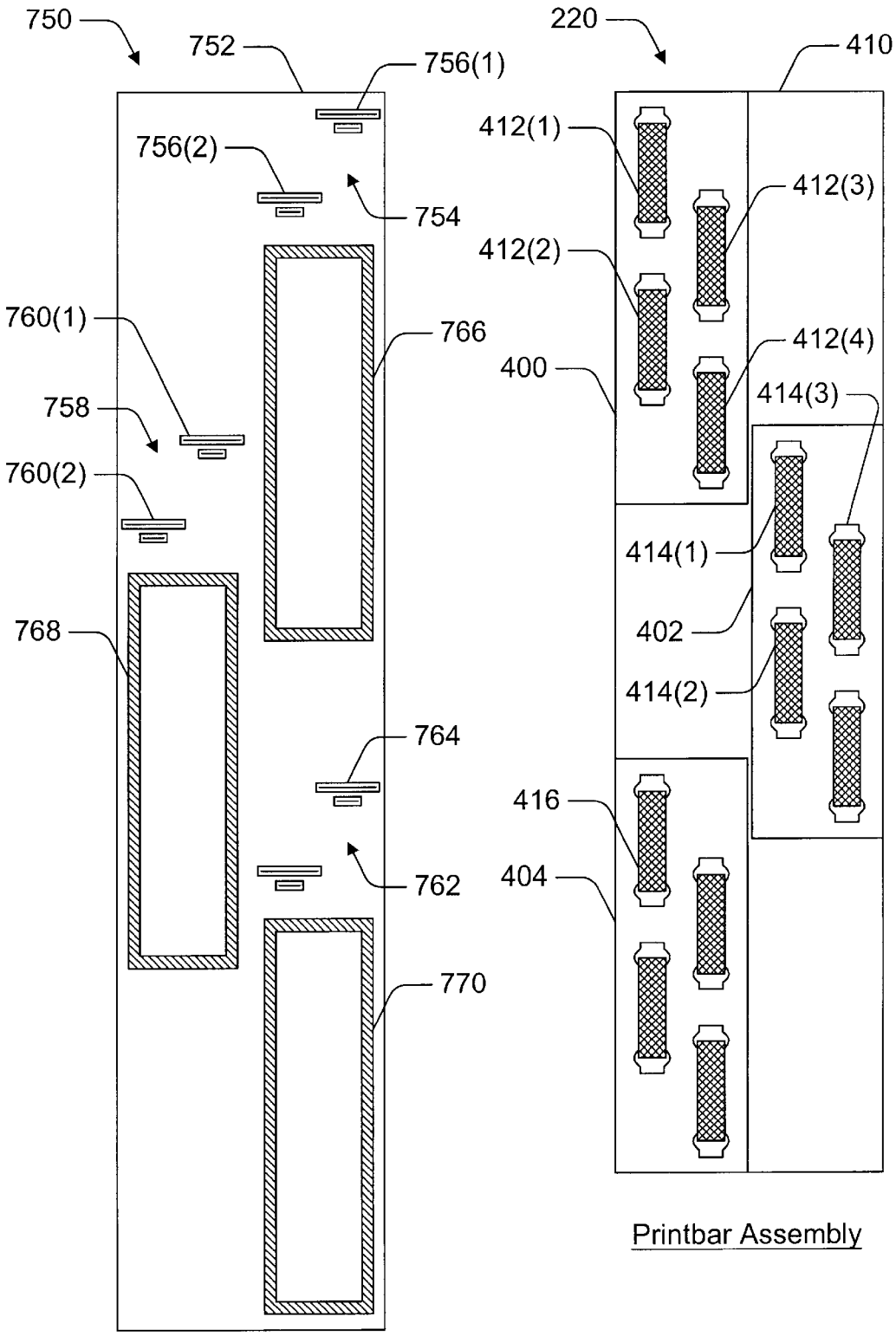
FIG. 13 is an illustration of a wiper assembly having wipers that correspond to printheads and printhead caps that correspond to print modules on a printbar assembly.

FIG. 13 illustrates components of an exemplary wiper assembly 750. The wiper assembly is shown adjacent printbar assembly 220 that is also illustrated in FIG. 4. FIG. 13 illustrates an exemplary alignment and configuration of wiper components and printhead caps on wiper assembly 750 with corresponding printheads on the printbar assembly 220.

Wiper assembly 750 has a framework 752 to support the wiper components and the printhead caps, and to install the wiper assembly in a printing device. Those skilled in the art will recognize that any number of varying framework configurations can be implemented to support the wiper components and the printhead caps, and the wiper assembly in a printing device.

Wiper assembly 750 can also include a drive mechanism (not shown) that facilitates the wiper assembly being positioned in proximity to a print bar assembly 220 such that wiper components on the wiper assembly 750 can contact and clean corresponding printheads on the printbar assembly 220. Wiper assembly 750 can also be positioned such that printhead caps on the wiper assembly engage and cover corresponding printheads and/or print modules on the printbar assembly 220. Either the wiper assembly 750 and/or the printbar assembly 220 can be moved in relation to the other to engage and cover the printheads with the printhead caps. The drive mechanism can comprise any conventional drive coupling device that is mechanically coupled to and powered by a separate power source, such as a motor.

Wiper assembly 750 has a first region 754 with wipers 756 illustrated in a configuration having two wipers, one having a width corresponding to one-half the width of a print module 400, and the other wiper having a width corresponding to the width of a printhead 412.

The wipers in region 754 correspond to the printheads 412 on print module 400. For example, wipers 756(1) correspond to printheads 412(1) and 412(2) (when the printbar assembly is "flipped over" and positioned above the wiper assembly, or vice-versa). When wipers 756(1) are positioned to contact printhead 412(1), the wipers are moved across the printhead in a direction that is parallel to a longitudinal axis 422 (FIG. 4) of the printhead to remove any ink residue and other contaminants from the printhead. It should be recognized that the movement between the wipers and the printhead is relative, and that the printhead can be moved across the wipers in a parallel direction relative to the wipers to clean the printhead. Furthermore, for bidirectional wiping, the wipers 756(1) can be moved in a first direction that is parallel to a longitudinal axis of printhead 412(1), and in a second direction that is opposite to the first direction, to clean printhead 412(1).

In a region 758 of wiper assembly 750, wipers 760 correspond to printheads 414 on print module 402, and each set of wipers 760 correspond to two of the printheads 414 that are aligned on print module 402. For example, wipers 760(1) clean printhead 414(1) and printhead 414(2) when the wipers contact the printheads and move in a direction that is parallel to a longitudinal axis 422 (FIG. 4) of the printheads. In a region 762 of wiper assembly 222, wipers 764 correspond to printheads 416 on print module 404.

Wiper assembly 750 also includes printhead caps 766, 768, and 770. The printhead caps are positioned on the wiper assembly between the wipers such that they do not interfere with cleaning the printheads on printbar assembly 220. Printhead cap 766 on wiper assembly 750 corresponds to print module 400 on printbar assembly 220. When the wiper assembly 750 and printbar assembly 220 are positioned for capping the print modules and/or printheads, printhead cap 766 engages print module 400 to cover printheads 412 on the print module 400. Similarly, printhead cap 768 engages print module 402 to cover printheads 414, and printhead cap 770 engages print module 404 to cover printheads 416. It should be recognized that capping movement between the printbar assembly 220 and the wiper assembly 750 is relative, and that either or both of the assemblies can be moved such that the printhead caps cover the printheads.

Exemplary Wiper Configurations

Figure 14:
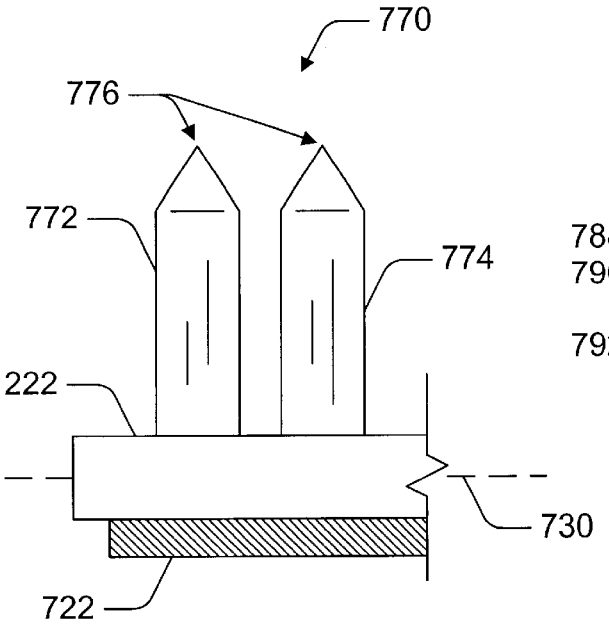
FIG. 14 is an illustration of a wiper assembly having a wiper configuration that includes two wipers.

FIG. 14 illustrates a section of a wiper assembly 222, such as shown in FIGS. 11 and 12, having a wiper configuration 770 that includes two wipers 772 and 774, although any number of wipers can be configured together to clean a corresponding printhead. FIG. 14 also illustrates a side-view section of printhead cap 722 and central longitudinal axis 730, as described above in reference to FIG. 12. The wipers 772 and 774 can be configured such as wipers 704 (FIG. 11), for example, where one wiper 772 corresponds to one-half the width of a print module 400, and the other wiper 774 has a width corresponding to the width of a printhead. Alternatively, the wipers can be configured such as wipers 710 (FIG. 11), where both wipers 772 and 774 are the same width and correspond to at least one-half the width of a print module.

Each of the wipers 772 and 774 have an elongated blade 776 that engages and wipes associated printhead nozzle sections to remove ink residue and build-up. The blade 776 of a wiper has sufficient width to wipe a cleaning path over all of the printhead nozzles in one pass across a corresponding printhead.

The wipers 772 and 774 can be formed of a resilient, non-abrasive, elastomeric material, such as nitrite rubber, ethylene polypropylene diene monomer (EPDM), or other comparable materials. Those skilled in the art will recognize that the wipers can be made with any number of varying materials, and combinations of materials.

Figure 15:
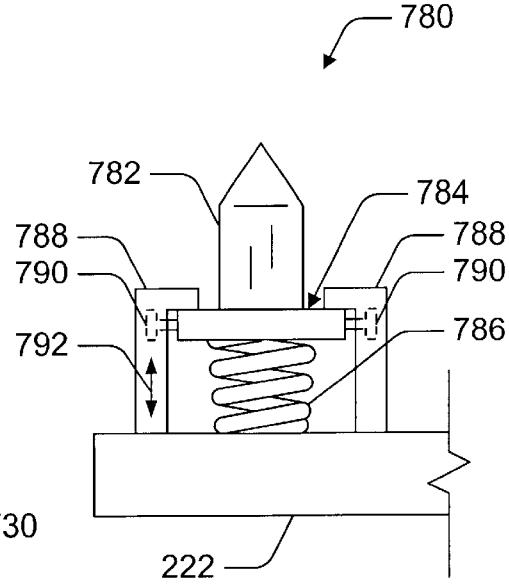
FIG. 15 is an illustration of a wiper assembly having a wiper configuration that includes a spring to apply pressure and hold a wiper in contact with a printhead.

FIG. 15 illustrates a section of a wiper assembly 222 having a wiper configuration 780 that includes a wiper 782 and a spring assembly 784. The configuration 780 can also include any number of wipers positioned together to clean a corresponding printhead, such as two wipers together as shown in configuration 770 (FIG. 14). The spring assembly 784 includes a spring 786 that applies a pressure, or force, to hold the wiper 782 in contact with a printhead while cleaning the printhead. The spring assembly 784 also includes guideposts 788 and slidable members 790 to align travel of the spring assembly in directions indicated by arrows 792.

Additionally, spring assembly 784 compensates for variations in spacing between the wiper assembly 222 and a corresponding printbar assembly that can be caused in part by manufacturing tolerances. Any spacing variations between a wiper assembly and a printbar assembly translate to spacing variations between a wiper and a printhead which can impair the cleaning effectiveness of the wiper due to inadequate contact with the printhead.

Methods for Servicing Printbar Assemblies

Figure 16:
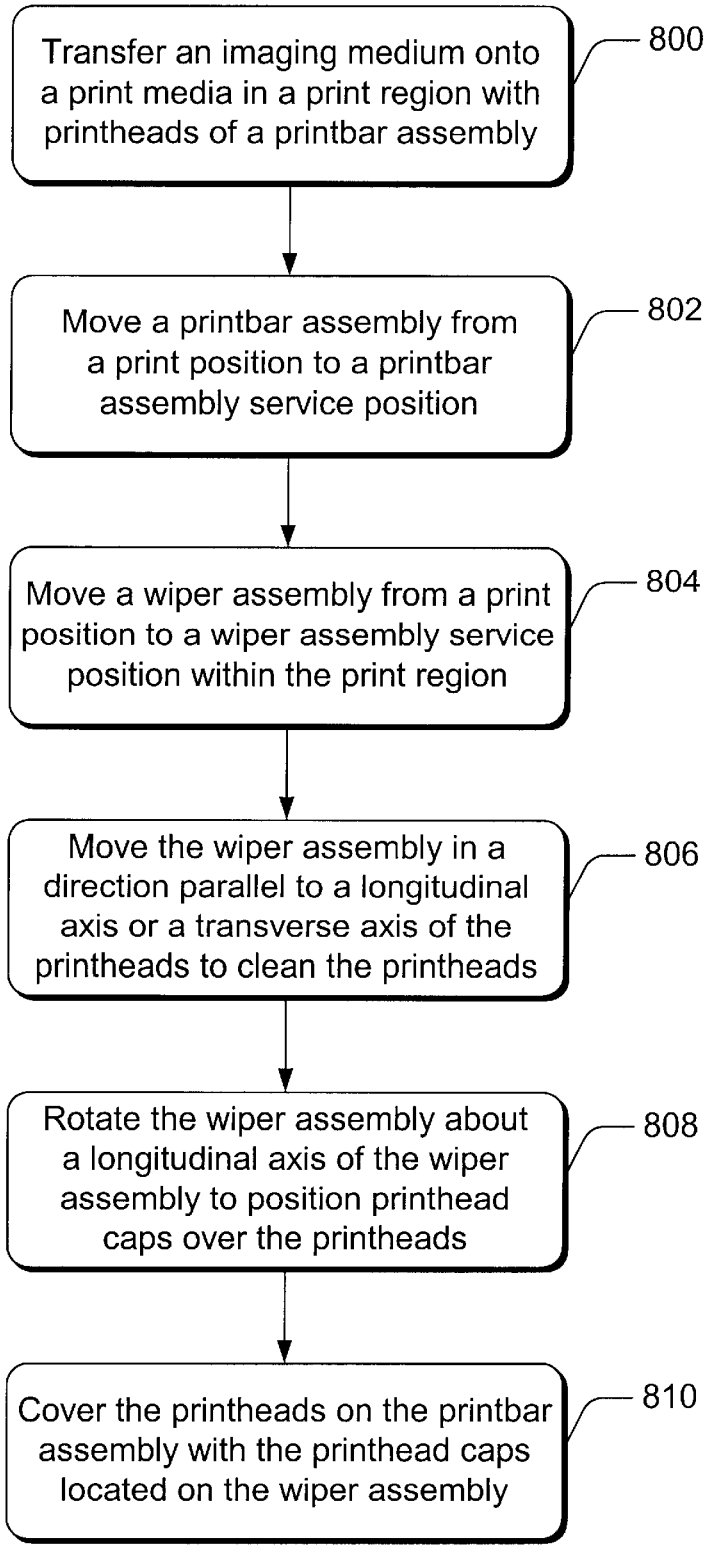
FIG. 16 is a flow diagram that describes a method for servicing a printbar assembly with a wiper assembly in a print region.

FIG. 16 illustrates a method for servicing printbar assemblies with corresponding wiper assemblies that are located within, or positioned within, a print region. The order in which the method is described is not intended to be construed as a limitation. Furthermore, the method can be implemented in any suitable hardware, software, firmware, or combination thereof In addition, the method can be implemented by one or more processors executing instructions that are maintained on a computer-readable media.

At block 800, an imaging medium, such as ink, is transferred onto a print media in a print region with printheads of a printbar assembly. A print module has one or more printheads, and one or more print modules are coupled to the printbar assembly. The printheads of the print modules collectively span a width of the print media when the printbar assembly is in a print position and the print modules remain fixed in the print position when transferring the imaging medium.

At block 802, a printbar assembly is moved from the print position to a printbar assembly service position. Multiple printbar assemblies can be moved independently, or together. The printbar assembly is moved to allow access to the printheads for servicing. The printbar assembly can be moved up from the print position in a direction perpendicular to a horizontal plane of the print media to the printbar assembly service position.

At block 804, a wiper assembly is moved from a print position to a wiper assembly service position over, or otherwise within, the print region. Multiple wiper assemblies can be moved independently, or together, to position one or more wipers coupled to the wiper assembly in contact with the printheads on the printbar assembly. The wiper assembly can be moved from the print position in a direction parallel to a horizontal plane of the print media to the wiper assembly service position.

At block 806, the printheads on the printbar assembly are serviced with wipers on the wiper assembly. The wiper assembly is moved in a direction parallel to a longitudinal axis of the printheads such that the wipers clean the printheads. Alternatively, the wiper assembly is moved in a direction parallel to a transverse axis of the printheads such that the wipers clean the printheads. It should be recognized that the movement between the wipers and the printheads is relative, and that the printheads can be moved across the wipers to clean the printheads with the wipers. Furthermore, for bidirectional wiping, the wiper assembly can be moved in a first direction, and then in a second direction opposite to the first direction to clean the printheads.

At block 808, the wiper assembly is rotated about a central longitudinal axis of the wiper assembly to position printhead caps coupled to the wiper assembly over the printheads on the printbar assembly. For example, wiper assembly 222 (FIGS. 11 and 12), is rotated about a central longitudinal axis 730 to position the printhead caps over the printheads. For wiper assembly 750 (FIG. 13), the printhead caps are coupled to the wiper assembly on the same side as the wipers and is not rotated to position the printhead caps over the printheads.

At block 810, the printheads on the printbar assembly are covered with the printhead caps coupled to a wiper assembly. The capping movement between the printbar assembly and the wiper assembly is relative, such that either or both of the assemblies can be moved to cover the printheads with the printhead caps.

Conclusion

The printbar assemblies and service station configurations described herein provide a fast response to clean printheads on the printbar assemblies by locating wiper assemblies in close proximity to the printheads. The wiper assemblies are positioned within the print region, or otherwise move into the print region, to service the printheads.

Although the invention has been described in language specific to structural features and/or methodological steps, it is to be understood that the invention defined in the appended claims is not necessarily limited to the specific features or steps described. Rather, the specific features and steps are disclosed as preferred forms of implementing the claimed invention.

What is claimed is:

1. An inkjet printing mechanism, comprising:

one or more printbar assemblies;

one or more print modules coupled to an individual printbar assembly, an individual print module having one or more printheads, the one or more printheads of the one or more print modules collectively configured to span a width of a print media and deposit ink onto the print media; and a service station having one or more wiper assemblies, an individual wiper assembly configured for movement to a wiper assembly service position mover the print media to service the printheads on the individual printbar assembly.

2. An inkjet printing mechanism as recited in claim 1, wherein the individual printbar assembly is configured to remain fixed in a print position when the ink is deposited onto the print media.

3. An inkjet printing mechanism as recited in claim 1, wherein the individual printbar assembly is configured to remain fixed in a print position when the ink is deposited onto the print media, and further configured for movement to a printbar assembly service position.

4. An inkjet printing mechanism as recited in claim 1, wherein the individual printbar assembly is configured to remain fixed in a first position when the ink is deposited onto the print media, and further configured for movement to a second position to service the printheads on the individual printbar assembly.

5. An inkjet printing mechanism as recited in claim 1, wherein the individual printbar assembly is configured to remain fixed in a first position when the ink is deposited onto the print media, and further configured to move in a direction perpendicular to a horizontal plane of the print media to a printbar assembly service position to service the printheads.

6. An inkjet printing mechanism as recited in claim 1, wherein the individual printbar assembly is configured to move in a direction perpendicular to a horizontal plane of the print media to a printbar assembly service position, and wherein the individual wiper assembly is configured to move in a direction parallel to a horizontal plane of the print media to the wiper assembly service position.

7. An inkjet printing mechanism as recited in claim 1, wherein:

the individual printbar assembly is configured to move in a direction perpendicular to a horizontal plane of the print media to a printbar assembly service position; and the individual wiper assembly is configured to move in a direction parallel to a horizontal plane of the print media to the wiper assembly service position, and further configured to move in a direction parallel to a longitudinal axis of the printheads on the individual printbar assembly to clean the printheads.

8. An inkjet printing mechanism as recited in claim 1, wherein:

the one or more print modules are configured to move in a direction perpendicular to a horizontal plane of the print media to a print module service position; and the one or more wiper assemblies are configured to move in a direction parallel to a horizontal plane of the print media to the wiper assembly service position, and further configured to move in a direction parallel to a longitudinal axis of the printheads on the one or more print modules to clean the printheads.

9. An inkjet printing mechanism as recited in claim 1, wherein:

the one or more print modules are configured to move in a direction perpendicular to a horizontal plane of the print media to a print module service position; and the one or more wiper assemblies are configured to move in a direction parallel to a transverse axis of the printheads on the one or more print modules to clean the printheads.

10. An inkjet printing mechanism as recited in claim 1, wherein:

the individual wiper assembly is configured to move in a direction parallel to a horizontal plane of the print media to the wiper assembly service position; and the individual printbar assembly is configured to move in a direction perpendicular to a horizontal plane of the print media to a printbar assembly service position, and further configured to move in a direction parallel to a longitudinal axis of the printheads on the individual printbar assembly to clean the printheads.

11. An inkjet printing mechanism as recited in claim 1, wherein:

the one or more wiper assemblies are configured to move in a direction parallel to a horizontal plane of the print media to the wiper assembly service position; and the one or more print modules are configured to move in a direction perpendicular to a horizontal plane of the print media to a print module service position, and further configured to move in a direction parallel to a longitudinal axis of the printheads on the one or more print modules to clean the printheads.

12. An inkjet printing mechanism as recited in claim 1, wherein the individual wiper assembly has one or more wipers configured to clean the printheads on the individual printbar assembly, and wherein the individual wiper assembly is configured to service the printheads with the one or more wipers.

13. An inkjet printing mechanism as recited in claim 1, wherein the individual wiper assembly has one or more printhead caps configured to cover the printheads on the individual printbar assembly, and wherein the individual wiper assembly is further configured for movement to cover the printheads with the one or more printhead caps.

14. An inkjet printing mechanism as recited in claim 1, wherein:

the individual wiper assembly has one or more printhead caps configured to cover the printheads on the individual printbar assembly;

the individual wiper assembly is configured to rotate about a central longitudinal axis of the wiper assembly to position the one or more printhead caps over the printheads; and the individual wiper assembly is further configured for movement to cover the printheads with the one or more printhead caps.

15. An inkjet printing mechanism as recited in claim 1, wherein:

the individual wiper assembly has one or more wipers configured to clean the printheads on the individual printbar assembly, and has one or more printhead caps configured to cover the printheads; and the individual wiper assembly is configured to service the printheads with the one or more wipers, and further configured to cover the printheads with the one or more printhead caps.

16. An inkjet printing mechanism as recited in claim 1, wherein:

the individual wiper assembly has one or more wipers configured to clean the printheads on the individual printbar assembly, and has one or more printhead caps configured to cover the printheads; and the individual wiper assembly is configured to service the printheads with the one or more wipers, rotate about a central longitudinal axis of the wiper assembly to position the one or more printhead caps over the printheads, and move to cover the printheads with the one or more printhead caps.

17. A print unit, comprising:

one or more print modules each having one or more printheads, the one or more printheads of the one or more print modules collectively configured to span a print region and transfer an imaging medium onto a print media in the print region; and one or more wiper assemblies positioned adjacent the one or more print modules over the print region, an individual wiper assembly having one or more wipers configured to clean a corresponding printhead.

18. A print unit as recited in claim 17, wherein the one or more print modules are configured to remain fixed in a first position when the imaging medium is transferred onto the print media, and further configured for movement to a second position for servicing the one or more printheads of the one or more print modules.

19. A print unit as recited in claim 17, wherein the one or more print modules and the one or more wiper assemblies are configured to remain fixed in a print position when the imaging medium is transferred onto the print media, and further configured for movement to a service position for servicing the one or more printheads of the one or more print modules.

20. A print unit as recited in claim 17, wherein:

the one or more print modules are configured to remain fixed in a first position when the imaging medium is transferred onto the print media, and further configured for movement to a second position for servicing the one or more printheads of the one or more print modules; and the one or more wiper assemblies are configured for movement to a service position such that the one or more wipers are positioned to clean the corresponding printhead.

21. A print unit as recited in claim 17, wherein the one or more print modules are configured to remain fixed in a first position when the imaging in medium is transferred onto the print media, and further configured to move in a direction perpendicular to a horizontal plane of the print media to a second position for servicing the one or more printheads of the one or more print modules.

22. A print unit as recited in claim 17, wherein:

the one or more print modules are configured to move in a direction perpendicular to a horizontal plane of the print media to a service position for servicing the one or more printheads of the one or more print modules; and the one or more wiper assemblies are configured to move in a direction parallel to a horizontal plane of the print media such that the one or more wipers are positioned to clean the corresponding printhead.

23. A print unit as recited in claim 17, wherein:

the one or more print modules are configured to move in a direction perpendicular to a horizontal plane of the print media to a print module service position for servicing the one or more printheads of the one or more print modules; and the one or more wiper assemblies are configured to move in a direction parallel to a horizontal plane of the print media to a wiper assembly service position, and further configured to move in a direction parallel to a longitudinal axis of the corresponding printhead such that the one or more wipers clean the corresponding printhead.

24. A print unit as recited in claim 17, wherein:

the one or more print modules are configured to move in a direction perpendicular to a horizontal plane of the print media to a print module service position for servicing the one or more printheads of the one or more print modules; and the one or more wiper assemblies are configured to move in a direction parallel to a horizontal plane of the print media to a wiper assembly service position, and further configured to move in a direction parallel to a transverse axis of the corresponding printhead such that the one or more wipers clean the corresponding printhead.

25. A print unit as recited in claim 17, wherein:

the one or more print modules are configured to move in a direction perpendicular to a horizontal plane of the print media to a print module service position for servicing the one or more printheads of the one or more print modules; and the one or more wiper assemblies are configured to move in a direction parallel to a transverse axis of the corresponding printhead such that the one or more wipers clean the corresponding printhead.

26. A print unit as recited in claim 17, wherein the individual wiper assembly has a printhead cap configured to cover the corresponding printhead, and wherein the individual wiper assembly is configured for movement to a capping position such that the printhead cap is positioned for engagement with the corresponding printhead.

27. A print unit as recited in claim 17, wherein the one or more wiper assemblies have one or more printhead caps configured to cover the one or more printheads of the one or more print modules, and wherein the one or more wiper assemblies are configured for movement to a capping position such that the one or more printhead caps are positioned for engagement with the one or more printheads of the one or more print modules.

28. A print unit as recited in claim 17, wherein the individual wiper assembly has a printhead cap configured to cover the corresponding printhead, and wherein the individual wiper assembly is configured to rotate about a central longitudinal axis of the wiper assembly to a capping position such that the printhead cap is positioned for engagement with the corresponding printhead.

29. A method, comprising:

transferring an imaging medium onto a print media in a print region with one or more printheads of one or more print modules, the one or more printheads collectively spanning a width of the print region; and servicing the one or more printheads with a wiper assembly positioned over the print region and adjacent the one or more print modules.

30. A method as recited in claim 29, wherein servicing comprises cleaning each of the one or more printheads with one or more wipers coupled to the wiper assembly.

31. A method as recited in claim 29, further comprising capping the one or more printheads with one or more printhead caps coupled to the wiper assembly.

32. A method as recited in claim 29, further comprising rotating the wiper assembly about a central longitudinal axis of the wiper assembly to position one or more printhead caps coupled to the wiper assembly over the one or more printheads, and capping the one or more printheads with the one or more printhead caps.

33. A method as recited in claim 29, wherein servicing comprises cleaning each of the one or more printheads with one or more wipers coupled to the wiper assembly, and capping the one or more printheads with one or more printhead caps coupled to the wiper assembly.

34. A method as recited in claim 29, wherein transferring comprises the one or more print modules remaining fixed in a print position, and wherein servicing comprises moving the one or more print modules to a service position.

35. A method as recited in claim 29, wherein transferring comprises the one or more print modules remaining fixed in a print position, and wherein servicing comprises moving the one or more print modules to a print module service position and moving the wiper assembly to a wiper assembly service position over the print region.

36. A method as recited in claim 29, wherein transferring comprises the one or more print modules remaining fixed in a print position, and wherein servicing comprises moving the one or more print modules in a direction perpendicular to a horizontal plane of the print media to a print module service position, and moving the wiper assembly in a direction parallel to a horizontal plane of the print media to a wiper assembly service position over the print region.

37. A method as recited in claim 29, wherein transferring comprises the one or more print modules remaining fixed in a print position, and wherein servicing comprises:

moving the one or more print modules in a direction perpendicular to a horizontal plane of the print media to a print module service position;

moving the wiper assembly in a direction parallel to a horizontal plane of the print media to a wiper assembly service position over the print region; and moving the wiper assembly in a direction parallel to a longitudinal axis of the one or more printheads to clean each of the one or more printheads with one or more wipers.

38. A method as recited in claim 29, wherein transferring comprises the one or more print modules remaining fixed in a print position, and wherein servicing comprises:

moving the one or more print modules in a direction perpendicular to a horizontal plane of the print media to a print module service position;

moving the wiper assembly in a direction parallel to a horizontal plane of the print media to a wiper assembly service position over the print region; and moving the wiper assembly in a direction parallel to a transverse axis of the one or more printheads to clean each of the one or more printheads with one or more wipers.

39. A method as recited in claim 29, wherein transferring comprises the one or more print modules remaining fixed in a print position, and wherein servicing comprises:

moving the one or more print modules in a direction perpendicular to a horizontal plane of the print media to a print module service position;

moving the wiper assembly in a direction parallel to a transverse axis of the one or more printheads to clean each of the one or more printheads with one or more wipers.

40. A method as recited in claim 29, wherein transferring comprises the one or more print modules remaining fixed in a print position, and wherein servicing comprises:

moving the one or more print modules in a direction perpendicular to a horizontal plane of the print media to a print module service position;

moving the wiper assembly in a direction parallel to a horizontal plane of the print media to a wiper assembly service position over the print region; and moving the one or more print modules in a direction parallel to a longitudinal axis of the one or more printheads to clean each of the one or more printheads with one or more wipers.

41. A method as recited in claim 29, wherein transferring comprises one or more print modules of a first printbar assembly remaining fixed in a print position, and wherein servicing comprises cleaning each of one or more printheads of one or more print modules of a second printbar assembly.

42. A method as recited in claim 29, wherein transferring comprises one or more printheads of a first printbar assembly remaining fixed in a print position and transferring the imaging medium onto the print media, and wherein servicing comprises cleaning each of one or more printheads of a second printbar assembly.

43. A method, comprising:

transferring ink onto a print media in a print region with a first set of one or more inkjet printheads of a first printbar assembly, the first set of one or more inkjet printheads collectively spanning a width of the print region; and servicing a second set of one or more inkjet printheads of a second printbar assembly with a wiper assembly positioned over the print region.

44. A method as recited in claim 43, wherein servicing comprises cleaning each of the second set of one or more inkjet printheads with one or more wipers coupled to the wiper assembly.

45. A method as recited in claim 43, further comprising servicing the first set of one or more inkjet printheads with a second wiper assembly positioned over the print region after transferring.

46. A method as recited in claim 43, wherein servicing comprises:

cleaning each of the second set of one or more inkjet printheads with one or more wipers coupled to the wiper assembly;

cleaning each of the first set of one or more inkjet printheads with one or more wipers coupled to a second wiper assembly after transferring.

47. A method as recited in claim 43, wherein servicing comprises:

cleaning each of the second set of one or more inkjet printheads with one or more wipers coupled to the wiper assembly;

cleaning each of the first set of one or more inkjet printheads with one or more wipers coupled to a second wiper assembly after transferring; and capping the second set of one or more inkjet printheads with one or more printhead caps coupled to the wiper assembly, and capping the first set of one or more inkjet printheads with one or more printhead caps coupled to the second wiper assembly.

48. A method as recited in claim 43, further comprising:

rotating the wiper assembly about a central longitudinal axis of the wiper assembly to position one or more printhead caps coupled to the wiper assembly over the second set of one or more inkjet printheads;

rotating a second wiper assembly about a central longitudinal axis of the second wiper assembly to position one or more printhead caps coupled to the second wiper assembly over the first set of one or more inkjet printheads after transferring; and capping the second set of one or more inkjet printheads with one or more printhead caps coupled to the wiper assembly, and capping the first set of one or more inkjet printheads with one or more printhead caps coupled to the second wiper assembly.

* * * * *